United States Patent [19]

Ito et al.

[11] Patent Number: 4,535,463

[45] Date of Patent: Aug. 13, 1985

[54] APPARATUS FOR DETECTING NUMBER OF REMAINING SHEETS

[75] Inventors: Masazumi Ito, Toyokawa; Kenzo Nagata, Okazaki, both of Japan

[73] Assignee: Minolta Camera Co., Ltd., Osaka, Japan

[21] Appl. No.: 423,078

[22] Filed: Sep. 24, 1982

[30] Foreign Application Priority Data

Oct. 13, 1981 [JP] Japan ..... 56-163825
Oct. 13, 1981 [JP] Japan ..... 56-163826

[51] Int. Cl.[3] ..... G06M 7/06
[52] U.S. Cl. ..... 377/8; 271/155
[58] Field of Search ..... 377/6, 8, 49; 355/14 CU; 271/155, 152, 153, 157, 215, 216, 217

[56] References Cited

U.S. PATENT DOCUMENTS 3,808,692 5/1974 Gartner ..... 33/138
4,045,016 8/1977 Amort ..... 271/155
4,157,738 6/1979 Nishiguchi et al. ..... 377/6
4,231,566 11/1980 Suzuki ..... 271/117
4,273,323 6/1981 Kaneko et al. ..... 271/157
4,285,591 8/1981 Botte et al. ..... 355/14 CU
4,417,351 11/1983 Williamson et al. ..... 377/8

FOREIGN PATENT DOCUMENTS 54-30779 9/1979 Japan .
113160 9/1979 Japan ..... 271/155

*Primary Examiner*—Stanley D. Miller
*Assistant Examiner*—K. Ohralik
*Attorney, Agent, or Firm*—Joseph W. Price

[57] ABSTRACT

An improved paper feeding device, for example, for a copying machine is provided and is capable of warning a user of the status of available copy paper sheets. A movable support tray can be monitored to provide a measurement of the total initial height of the paper stack and subsequent movements of this paper stack to introduce individual copy paper sheets into a paper transport system can be correlated with the actual number of sheets that are transported. From these monitored values, it is possible to calculate the number of sheets remaining on the stack and to provide an audible, vocal or visual display of the actual number or relative condition to warn a user.

15 Claims, 19 Drawing Figures

APPARATUS FOR DETECTING NUMBER OF REMAINING SHEETS

BACKGROUND OF THE INVENTION

1. Field of the Invention

The present invention is in the field of, for example, photocopiers, and more particularly for detecting the number of copy sheets remaining in a paper feeder which holds a stack of copy paper sheets therein and which is adapted to lift the stock to a specific position every time the height of the stack decreases by a predetermined amount.

2. Description of the Prior Art

Various forms of paper feeders for copying machines, printing machines, and the like have been generally known and accommodate a large number of copy sheets of paper that are arranged in stacks for copying and printing. Usually the stacks of copying paper are held within the photocopier or printing machine and are sequentially supplied to a processing station by an automatic feed mechanism. Copy paper feeders of this type are adapted to accommodate a larger number of sheets than detachable cassettes which have gained popularity in recent years. Thus the stacked paper feeders are usually more useful for high speed copying machines and those applications that require a continuous feed of a large number of sheets of copy paper.

Paper feeders that can accommodate a large stack of copy sheets have a drawback in that the stack is usually inaccessible or inconvenient to the user. It is frequently impossible to check the number of remaining copy sheets that are still in the machine and the machine will frequently automatically cease copying when the copy sheets decrease to a stack height of a predetermined amount.

The prior art has suggested paper feeders which would incorporate a mechanical index that would be movable with the decreasing amount of sheets or which would give a display of "Near Empty" to indicate that the stack has reduced to below a specific height. These proposed indexing or display methods, although capable of approximately showing the number of remaining copy sheets in the machine, fail to provide an accurate count. Another problem exists with a display system in that, after a period of time or when a different person uses the machine, generally the user is incapable of relying upon the display to provide even a rough approximation of the number of sheets that are still remaining in the machine. Consequently, the user may set the machine to reproduce a number of copies that are larger than the number of remaining copy sheets that are available. Finally, the use of a mechanical index to disclose the height of the stack has an inherent problem in that the actual number of copy sheets that may be positioned in any one stack arrangement can vary depending upon the thickness of the sheets, although the same height is indicated by the index.

The prior art is still looking for a convenient and economical apparatus that can be utilized in a photocopying environment to determine the actual number of copying sheets that are available to the user at any one time.

SUMMARY OF THE INVENTION

A main object of the present invention is to provide an apparatus for detecting the number of remaining copy sheets and accurately displaying the same irrespective of the thickness of the individual copy sheets.

Another object of the invention is to provide an apparatus for detecting the number of remaining copy sheets in conjunction with the mechanism which holds the stack of copy sheets and which adjusts the height of the copy sheets by a predetermined amount during use. Another object of the invention is to provide an apparatus for detecting the number of remaining copy sheets and displaying that number in an efficient manner to the user.

Another object of the present invention is to provide an apparatus for detecting the number of remaining copy sheets and also for providing an alarm or indicator signal whenever an attempt is made by the user to instruct the machine to make a larger number of copy sheets than that which is available in the paper feeder.

The present invention provides an improved paper feeder that incorporates a mechanism for holding the stack of copy sheets on a tray and for lifting the stack to a predetermined upper limit position every time the height of the stack decreases by a specific amount during the copying cycle. The present invention provides an apparatus for detecting the number of remaining copy sheets including means for generating signals with the actual lifting of the copy paper stack and means for counting the number of copy sheets used during the decrease of the paper stack by a specific amount. Computational means is provided for detecting the signals generated with the lift of the copy paper stack to obtain numerical data corresponding to the amount of that lift, including means for obtaining numerical data corresponding to the height of the remaining stack. Thus, from the raw data corresponding to the increment of the movement of the lift, the number of sheets that are actually used and the present height of the remaining copy stock, it is possible to calculate the remaining copy sheets that are available to the user. The present invention further provides a detecting apparatus of the type described wherein signals generated from the lift are pulse signals generated in synchronous with the drive of the mechanism for lifting the stack. The invention further provides a detecting apparatus of the type described which has means for displaying to the user the result of the calculation of the number of copy sheets remaining and available for a copying cycle.

The features of the present invention, which are believed to be novel, are set forth with particularity in the appending claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENT

The following specification, taken in conjunction with the drawings, sets forth the preferred embodiment of the present invention. The embodiments of the invention disclosed herein are the best modes contemplated by the inventors for carrying out their invention in the electro-photographic copying field, although it should be understood that various modifications can be accomplished within the parameters of the present invention and the invention may have applications to other similar apparatus which utilize a paper feeder.

Figure 1:
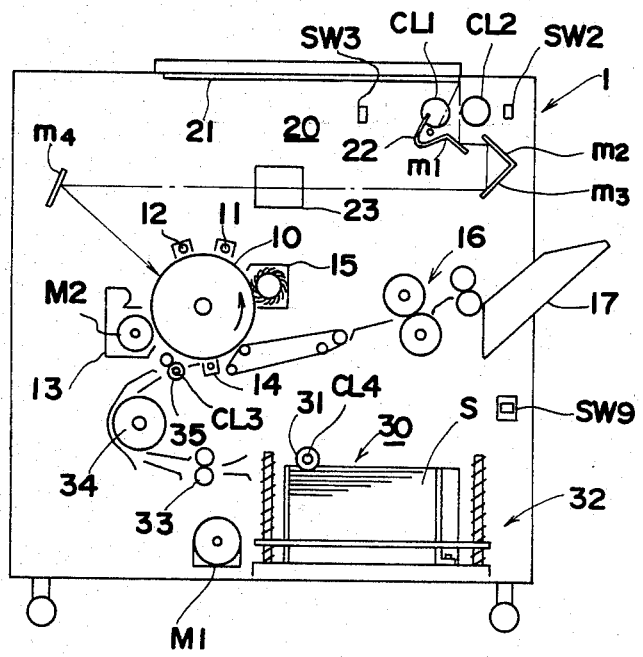
FIG. 1 schematically shows the construction of a copying machine embodying the invention.

FIG. 1 shows the construction of an electrophotographic copying machine 1 which incorporates the present invention. The construction and operation of the copying machine will now be described with reference to this drawing.

A photoconductive drum 10, rotatable in the direction of the arrow shown, is supported approximately at the center of the main body of the copying machine. Arranged around the drum 10 are an eraser lamp 11, a sensitizing charger 12, a developing unit 13, a transfer charger 14, a cleaner 15, etc. An original (not shown) is placed on a glass plate 21 and scanned by an optical system 20 including a lamp 22, reflecting mirrors m1 to m4 and a lens 23. The image of the original is projected continually onto the drum 10. The construction of the optical system and the scanning movement are well known and therefore need not be described in detail herein.

A paper feeder 30 comprises a feed roller 31 and a holder assembly 32 for holding a stack of copy paper sheets S and for lifting the paper stack upwards toward the feed roller 31 as will be described later. In a timed relationship with a copying operation, the feed roller 31 is rotated to transport the sheets S one by one from their uppermost position in the paper stack, and each copy sheet sent out is conveyed toward the drum 10 by a paper transportation system which includes transport rollers 33, 34, a timing roller 35, guides, etc.

With the above arrangement, the drum 10 is rotated with the start of copying operation. An image is formed on the surface of the drum 10 by sensitization, exposure and development and is transferred by the transfer charger 14 onto the copy sheet fed to the drum 10 in synchronism with the image forming operation. The copy sheet having the image transferred thereto is separated from the surface of the drum 10, passed through a fixing unit 16 to have the image fixed thereto and is then delivered onto a disposed tray 17. After the transfer, the toner and the charge remaining on the drum 10 are removed by the cleaner 15 and the eraser lamp 11 in preparation for the next copying cycle.

FIG. 1 further shows a main motor M1 for driving the drum 10, the optical system 20, the paper transportation system, a developing motor M2 for agitation of the developer and clutches CL1 and CL2 for the optical system 20 to provide a scan and return, a clutch CL3 for the timing roller and a clutch CL4 for the feed roller 31.

Figure 2A:
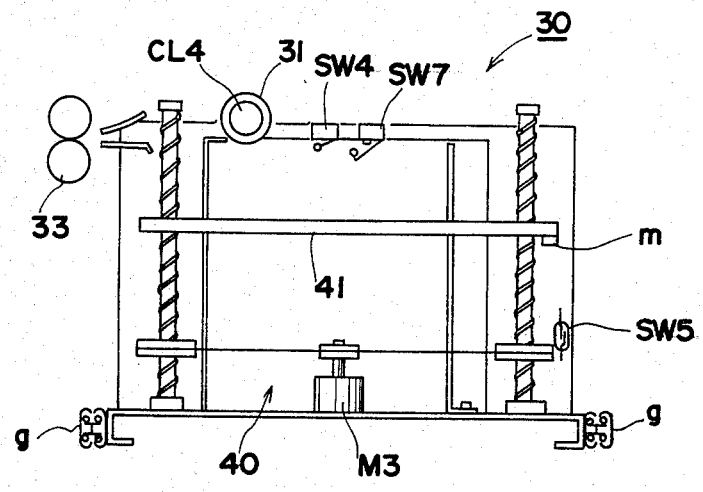
FIGS. 2(*a*) and (*b*) show a paper feeder elevator in the machine.
Figure 2B:
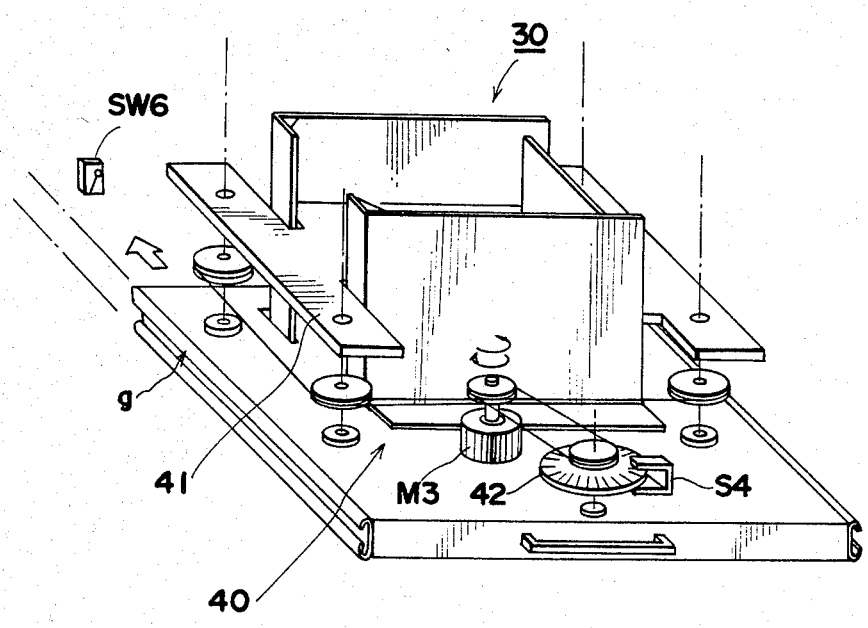

FIGS. 2(*a*) and (*b*) schematically show the paper feeder 30, in which the stack of copy sheets is held on a paper tray 41 of an elevator 40. The elevator 40 is driven by a reversible motor M3 which in turn drives a pulley and screw system.

When copy sheets are to be set on the paper tray 41, a tray withdrawing switch SW9 (see FIGS. 1 and 3), provided near the feeder 30, is turned on to drive the motor M3 and to lower the tray 41 until a magnet, m, activates a lower limit switch SW5. This renders the tray 41 withdrawable from the machine. When the tray 41 is pushed into the copy machine to a specified position with sheets set on the tray 41, a sensor switch SW6 functions to drive the motor M3 and lift the tray 41 until the stack of sheets activates an upper limit switch SW4.

When the height of the stack of copy sheets decreases due to the use of sheets during a copying operation, a switch SW7 opens, whereupon the motor M3 operates to lift the tray 41 until the upper limit switch SW4 is activated. The tray 41 is lifted in this way repeatedly during a copying operation.

The drive shaft of the motor M3 or a shaft driven in a fixed relationship thereto is fixedly provided with a pulse disk 42 for generating discrete pulse signals corresponding in number to the amount of rotation of the motor M3, i.e., which is a direct function of the amount of vertical movement of the paper tray 41. The pulse signals are used for detecting the number of remaining copy sheets on the tray 41 as will be described later.

The foregoing photocopier assembly including the paper feeder 30 of the copying machine 1 is controlled by a microcomputer (hereinafter abbreviated as "MC") 50 shown in FIG. 3. The sensor switches and drive means of the copying machine 1 are associated with the ports of the MC as shown in FIGS. 3 to 6.

Figure 3:
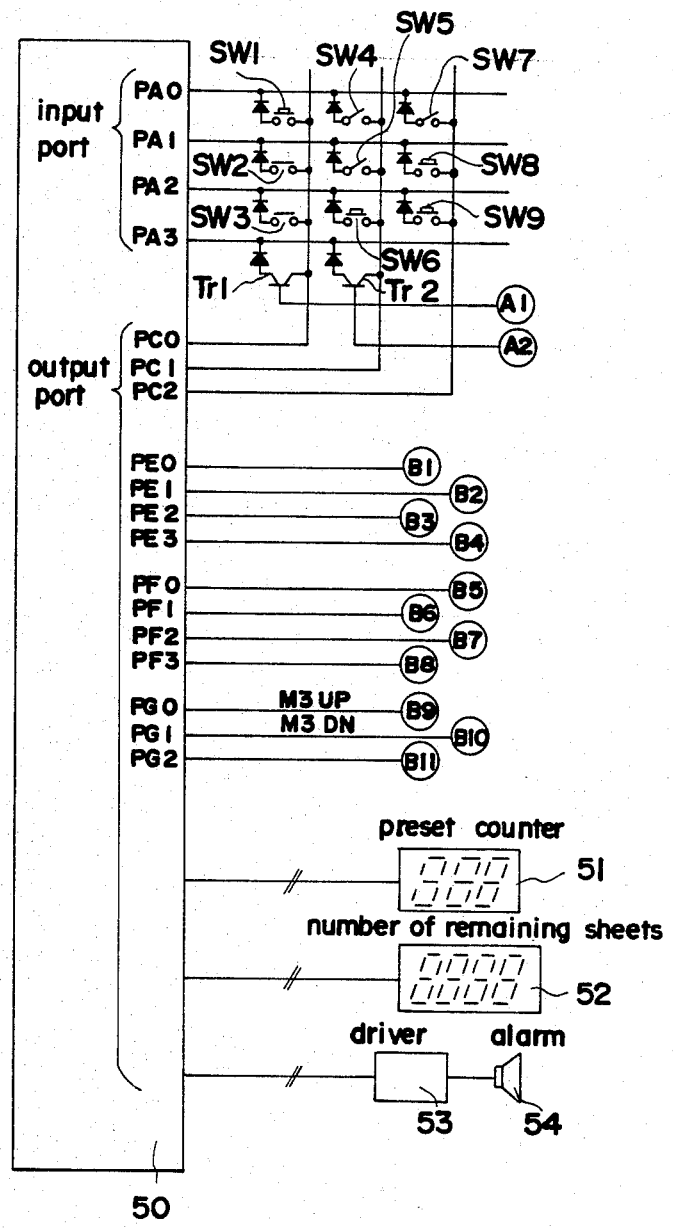
FIG. 3 shows the schematic relationship between the ports of a control microcomputer and the various switches and inputs.

FIG. 3 shows a print switch SW1 for starting a copying operation, a home position switch SW2 for detecting the home position of the optical system 20, a timing switch SW3 which is actuated with the movement of the optical system 20 for producing a signal for driving the timing roller 35, a switch SW8 for requesting a display of the number of remaining copy sheets, a transistor Tr1 which performs a switching action in response to a first pulse signal in synchronism with the rotation of the main motor M1, and a transistor Tr2 which performs a switching action in response to a second pulse signal as timed with the rotation of the drive motor M3 for the elevator. The first pulse signal synchronized with the rotation of the main motor M1 is generated by a pulse disk (not shown) fixed to the drive shaft of the main motor M1 for synchronizing the control to be effected by the MC 50 with the drive of the motor M1. The relationship between the pulse signal and the control by the MC 50 is such that the control routine is executed by the MC 50 upon generation of a motor pulse as disclosed, for example, in U.S. Pat. No. 4,280,763 of Arai et al. granted on July 28, 1981 which is incorporated herein by reference.

FIG. 3 further shows a preset counter 51 for setting and displaying the number of operating cycles of the copying machine 1 with an input from unillustrated number setting keys, and means 52 for displaying the number of remaining sheets calculated by the process to be described herein.

Figure 4:
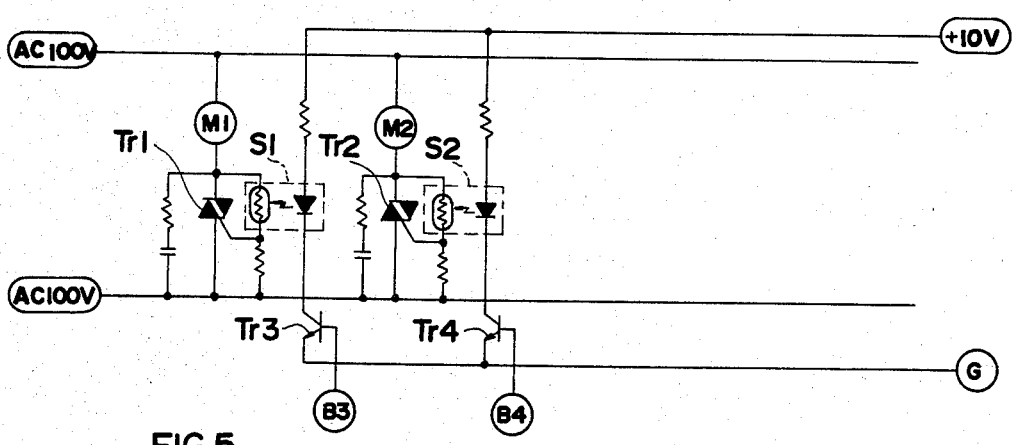
FIG. 4 shows a circuit for driving motors.

FIG. 4 shows a control circuit for driving the main motor M1 and the developing motor M2. Output ports PE2, PE3 of the MC 50 are connected respectively to the bases of transistors Tr3, Tr4, which, when conducting, close switching means S1, S2 to bring the control elements Tr1, Tr2 into conduction and energize the motors M1, M2.

Figure 5:
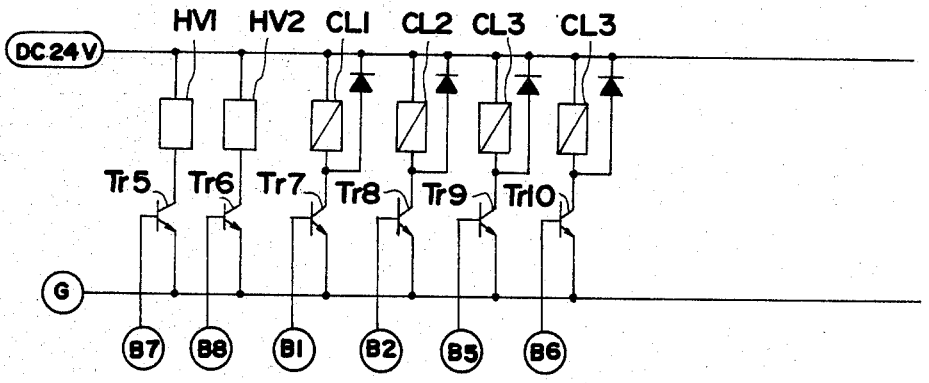
FIG. 5 shows a circuit for controlling clutches and high-voltage power supplies.

FIG. 5 shows a control circuit for the chargers and the clutches. Output ports PF2, PF3 of the MC 50 are connected via transistors Tr5, Tr6 to high-voltage power supplies HV1, HV2 for the sensitizing and transfer chargers 12, 14 respectively. Output ports PE0, PE1, PF0 and PF1 are similarly connected to the scan clutch CL1 for moving the optical system 20 in the scan direction, the return clutch CL2 for returning the optical system 20, the timing roller clutch CL3 and the paper feed roller clutch CL4 respectively.

Figure 6:
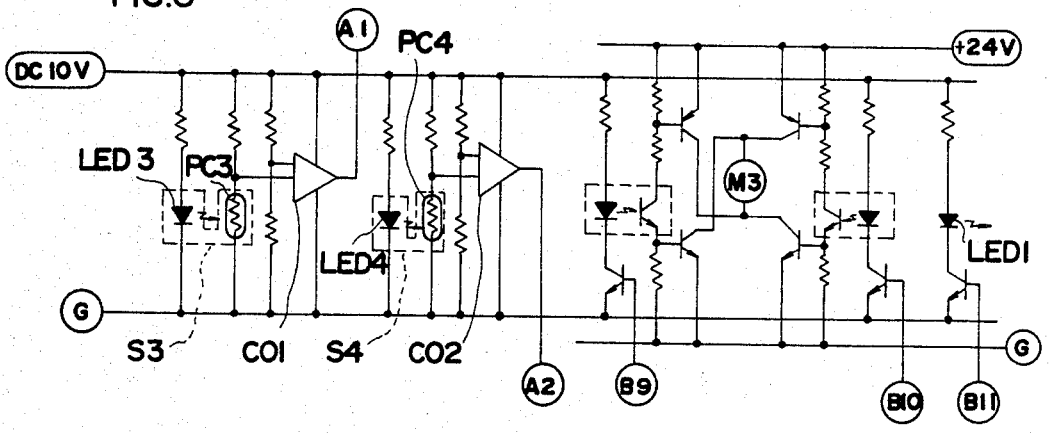
FIG. 6 shows pulse generating circuits and a circuit for driving a motor for the elevator.

FIG. 6 displays a circuit for generating pulse signals in synchronism with the rotation of the main motor M1 and the elevator motor M3, and a circuit for driving the elevator motor M3 and a light-emitting diode LED1 for displaying a deficiency of copy sheets. The unillustrated disk for generating the main motor pulses and the disk 42 for generating elevator motor pulses have slits of specified pitch in their outer peripheral portions and are provided with switching means S3 and S4 comprising a light-emitting diode LED3 and a photocell PC3, and a light-emitting diode LED4 and a photocell PC4, respectively. The diode and the photocell of each switching means are arranged on the opposite sides of the corresponding slitted portions. With the rotation of the pulse disks comparators C01 and C02 deliver pulse signals. The motor M3, which is reversibly rotatable, raises or lowers the elevator 40 in accordance with the output from an output port PG0 or PG1 of the MC 50. The display light-emitting diode LED1 is connected to the output port PG2 and is activated to provide an alarm indicating a deficiency of copy sheets, for example, when a numerical value larger than the number of remaining sheets is fed to the preset counter 51 by a user.

Figure 7A:
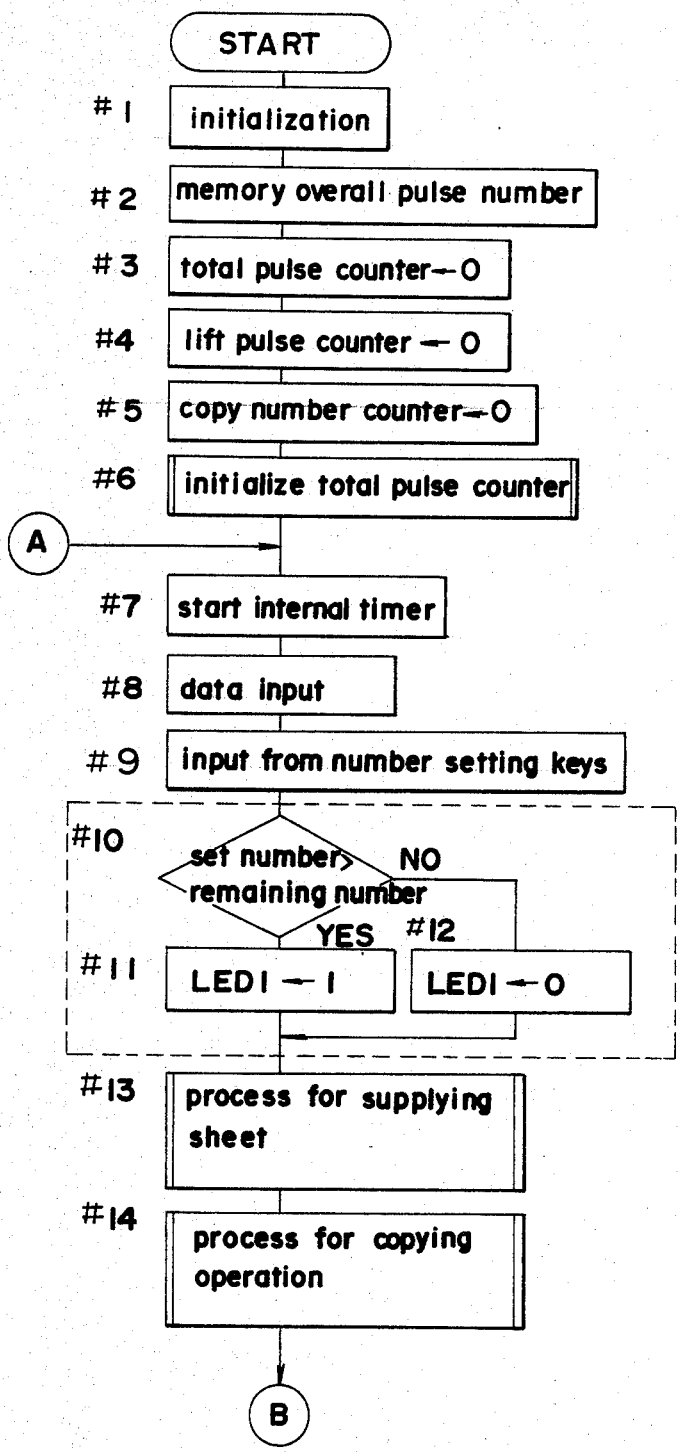
FIGS. 7(*a*) and (*b*) are flow charts showing the control process to be executed by the microcomputer.
Figure 7B:
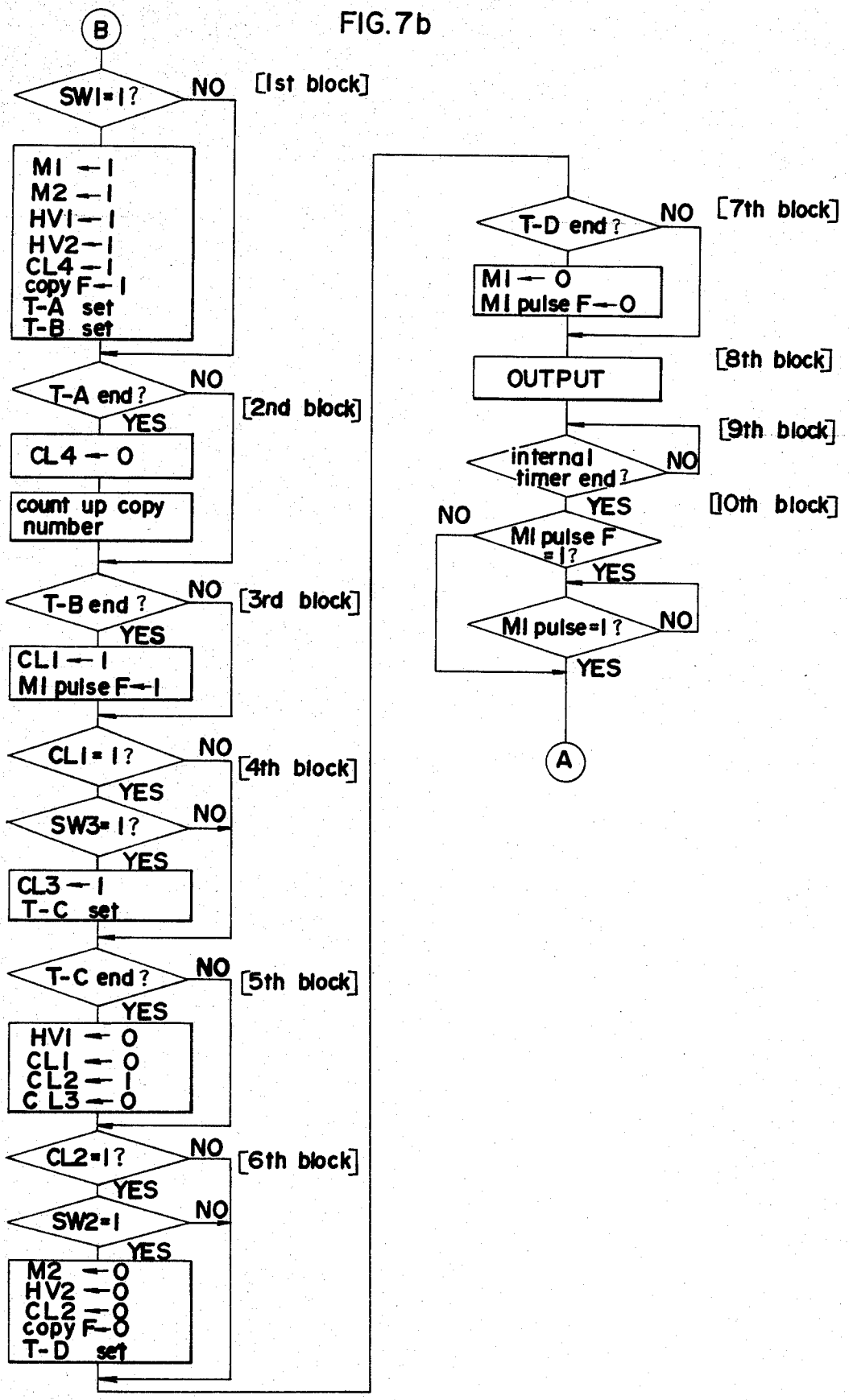

The MC 50 thus associated with the copying machine 1 controls the operation of the machine 1 in accordance with a program having stored therein the processing steps shown in the flow charts of FIGS. 7(*a*) and (*b*).

Upon turning on the power supply, step #1 first effects initialization by setting the copying machine 1 to a set of standard conditions read out from a stored memory address and includes a copy number of 1, copy magnification of X1, a standard exposure, usual copying mode, etc., and also by clearing the RAM (random access memory) of the MC 50.

Step #2 stores in the memory the number of motor pulses generated when the paper tray 41 of the elevator moves from the position of the lower limit switch SW5 to that of the upper limit switch SW4. The overall pulse number can be predetermined by calculation or actual measurement.

A total pulse counter, a lift pulse counter and a copy number counter which perform counting through the steps to be described below are cleared to "0" in steps #3 to #5 respectively. The total pulse counter is initialized in step #6.

Figure 8:
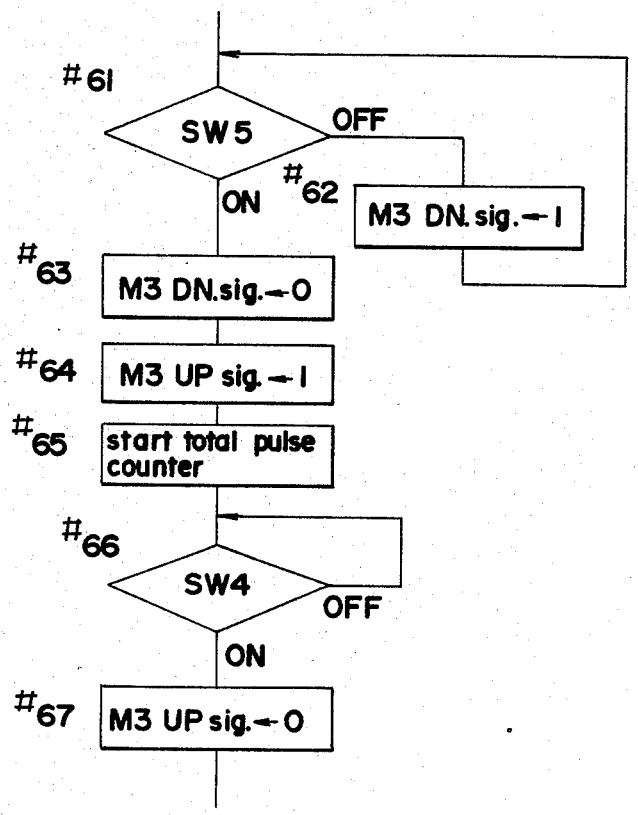
FIG. 8 is a flow chart showing in detail step #6 in the flow chart of FIG. 7(*a*)

FIG. 8 shows step #6 in detail. When the total pulse counter is initialized, i.e., when the power supply for the copying machine is turned on, the paper tray 41 is continually lowered into a final contact with the lower limit switch SW5 as shown in steps #61 and #62, and the motor M3 is thereafter controlled in steps #64 to #67 to lift the tray 41 until the upper limit switch SW4 is closed by the stack of copy sheets. The pulse counter counts up the pulse signals from the pulse disk 42 rotating with the motor M3 during the lift and stores the count upon the tray coming to a halt. Thus the height of the stack is determined from the relation of the initial number of pulses during the lift to the above-mentioned overall pulse number.

An internal timer is started in step #7 to set the processing time for one routine for the MC 50. Indicated at #8 is a data input step, and at #9 the step of processing an input from the number setting keys (not shown).

In steps #10 to #12, the set number input processed in step #9 is compared with the number of remaining sheets determined by a step to be described later. When the set number is larger than the latter number, the light-emitting diode LED1 is turned on to provide an alarm signal in step #11 to display the deficiency of copy sheets for the desired copying cycles. At this time, a voice generating means indicated at 53 and 54 in FIG. 3 may give an audible alarm of the deficiency. Step #13 is a process for supplying sheets for replenishment.

Figure 9:
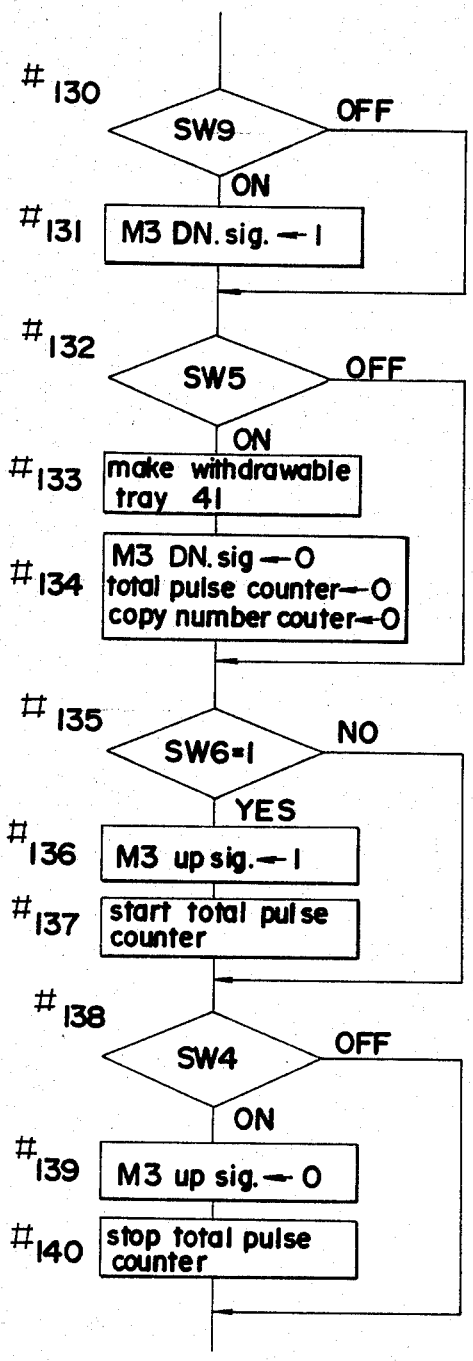
FIG. 9 is a flow chart showing in detail step #13 in FIG. 7(*a*)

FIG. 9 shows step #13 in detail. In the event of a paper deficiency, the tray withdrawing switch SW9 is manipulated by the user (see FIGS. 1 and 3). This is detected in step #130, whereupon the motor M3 is controlled to lower the elevator in step #131. When closing of the lower limit switch SW5 is detected in step #132, the motor M3 is stopped, the tray 41 is made withdrawable, and the total pulse counter and copy number counter are cleared to "0" in steps #133 and #134. The user then withdraws the tray, replenishes the tray with a suitable amount of sheets and pushes the tray 41 into the machine, whereupon the sensor switch SW6 is closed. The closing of the switch is recognized in step #136. In steps #136 through #140, the motor M3 is rotated to lift the elevator, the pulses generated are counted up by the total pulse counter, and the motor M3 and the counter are stopped when the upper limit switch SW4 is closed. In this way the same process as the foregoing initialization (step #6) is executed for the total pulse counter.

Figure 10:
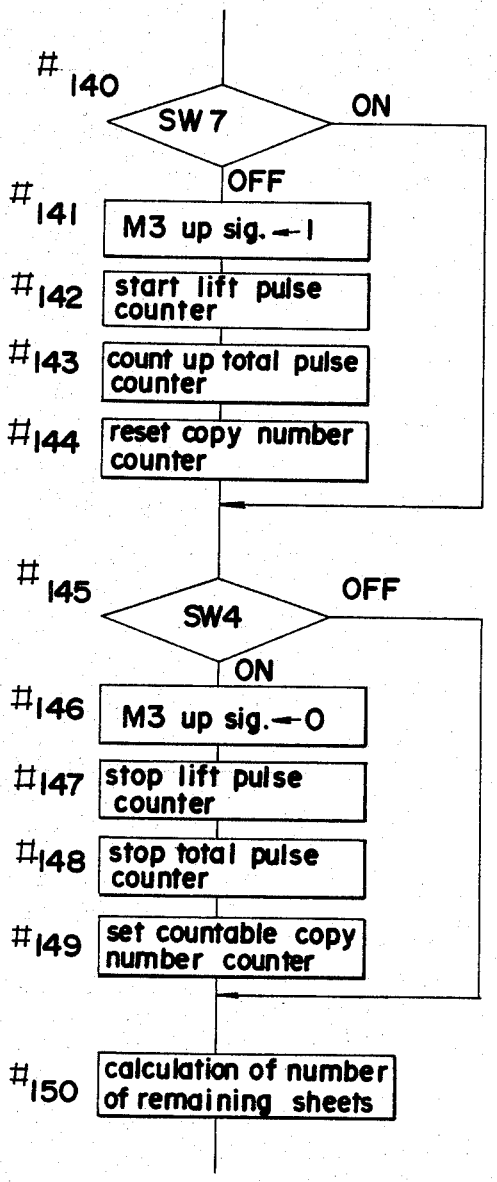
FIG. 10 is a flow chart showing in detail step #14 in FIG. 7(*a*)

During the copying operation by the machine 1, the paper feeder 30 is controlled by step #14, which is illustrated in detail in FIG. 10. When the lift switch SW7 is turned off with a decrease in the amount of sheets, steps #141 to #144 are executed wherein the motor M3 is rotated to raise the elevator, the lift pulse counter starts to count up the motor pulses generated, with the total pulse counter simultaneously operated for adding the count, and the copy number counter is reset. When the upper limit switch SW4 is turned on, steps #146 to #149 follow to stop the motor M3, the lift pulse counter and the total pulse counter and render the copy number counter ready for operation. The number of remaining sheets is calculated in step #150.

The calculation of the number of remaining sheets will be described in detail. The above-mentioned overall pulse number (set in step #2) is the number of pulses generated from the pulse disk 42 by the rotation of the motor M3 when the tray 41 moves from the position of the lower limit switch SW5 to that of the upper limit switch SW4. The number will be represented by Pt (known). The initially set pulse number is the number of motor pulses generated following the closing of the power supply or placement of sheets, during the period from the start of the lift of the tray 41 from the position of the lower limit switch SW5 until the stack of sheets is detected by the upper limit switch SW4. The initial pulse number will be represented by Pi. Assuming that the height of the stack of sheets in terms of pulse number is Po, Po is expressed by:

$$Po = Pt - Pi$$

When the count of lift pulses, which is the number of motor pulses corresponding to the distance of each lift, is Pn, the total pulse count Psn is expressed by:

$$Psn = Pi + \sum_{n} Pn$$

Suppose n for $$\sum_{n}$$

is 1 for simplified explanation, $$Psl = Pi + Pl$$

It therefore follows that an instance of lift reduces the initial height of the stack of sheets by Pl in terms of pulse number. Accordingly the height of the remaining stack Px as expressed in terms of pulse number is:

$$Px = Po - Pl = Pt - Psl$$

The number of sheets actually used and corresponding to the reduction of height, Pl, is countable by the copy number counter. If the count is n for Pl and further if the remaining sheets are of the same kind as those used, the number of remaining sheets, N, is given by:

$$N = \frac{Px \times n}{Pl} = \frac{Pt - Psl}{Pl} \times n$$

It is to be noted that Pt can be predetermined from the distance of lift of the tray 41, the pitch of the slits of the pulse disk 42 and the relation of the distance of lift to the number of revolutions of the motor M3. Thus by counting the pulse number corresponding to the instance of lift, the number of sheets, n, used and corresponding to the lift and the sum Psn of the initially set pulse number Pi and the lift pulse number, the number of remaining sheets, N, is given by:

$$N = \frac{Pt - Psn}{Pn} \times n$$

Figure 11:
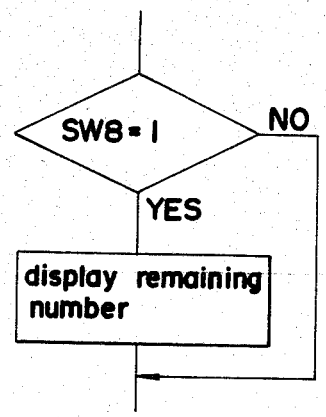
FIGS. 11, 12, 13 and 16 are flow charts showing modifications of the flow chart of FIG. 7(*a*)

With reference to the flow chart of FIG. 10, the number of remaining sheets can be displayed by performing the above calculation every time the motor M3 is operated, i.e., every time the tray is lifted. However, if the sheets initially set on the tray all have the same thickness and when the above calculation is performed once to determine the number of remaining sheets concerned, the number of remaining sheets to be determined subsequently for display can be obtained merely by counting up the sheets thereafter used and subtracting the count from the preceding number of remaining sheets. The process shown in FIG. 10 has an advantage that the number of remaining sheets can be corrected every time the calculation is performed when sheets of randomly varying thicknesses are used. Although the number of remaining sheets can be displayed on the display 52 of FIG. 3 every time it is calculated, the display may be adapted to function only when the display request switch SW8 (see FIG. 3) is turned on as seen in FIG. 11.

Figure 12:
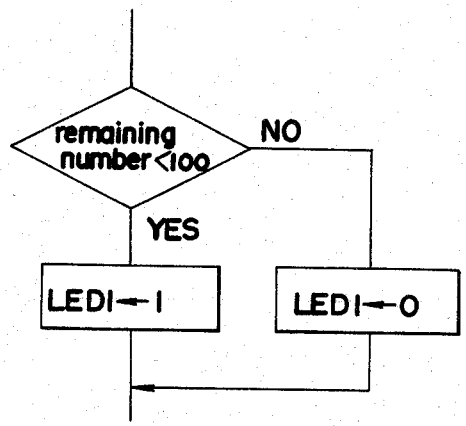

Further as shown in FIG. 12, an output for displaying the remaining number of copy sheets may be given when the result of calculation is smaller than a given number of sheets (e.g., 100). Unlike the conventional "near empty" display, this mode of display serves to completely eliminate the likelihood that the user will set a number of copies larger than the remaining number.

Figure 13:
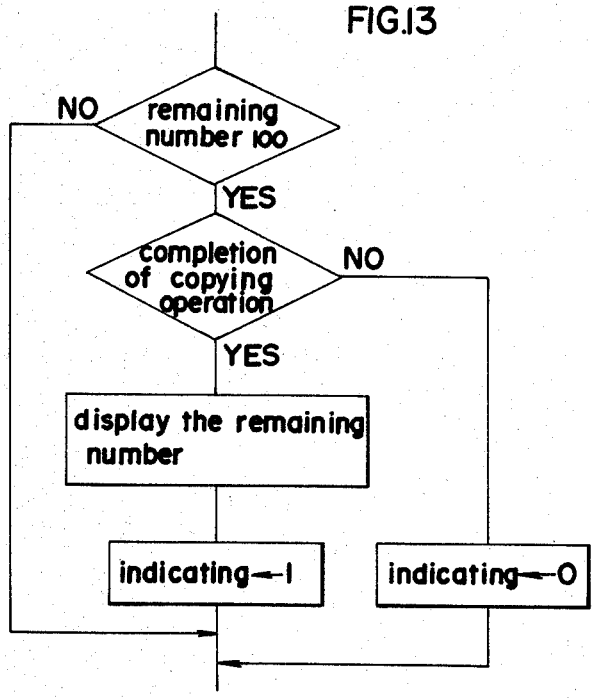

Further as shown in FIG. 13, the number of remaining sheets may be displayed or a vocal alarm may be given on completion of a copying operation when the number of remaining sheets becomes smaller than a predetermined number (e.g., 100). To direct the attention of the user to the display, a lamp may be turned on indicating that the display is on.

Figure 15:
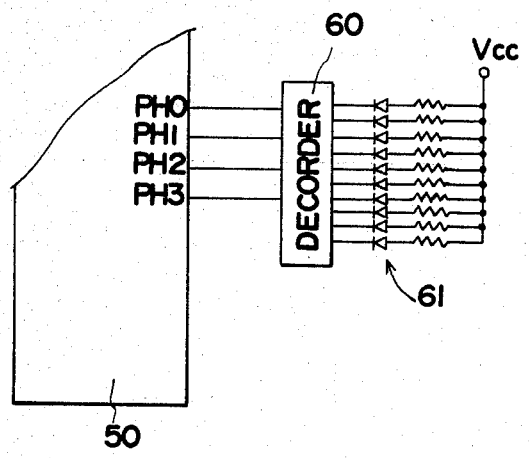
FIG. 15 shows an example of a display circuit.
Figure 16:
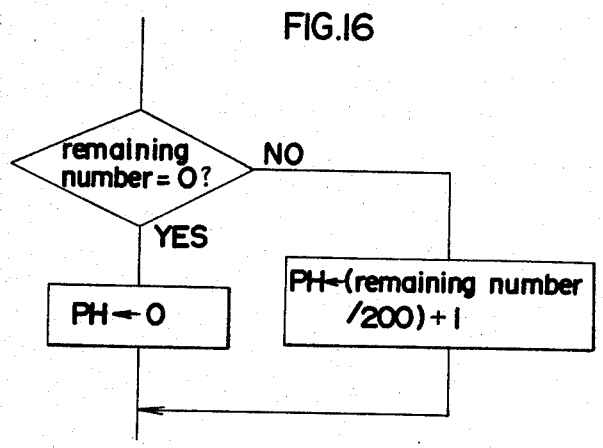
Figure 17:
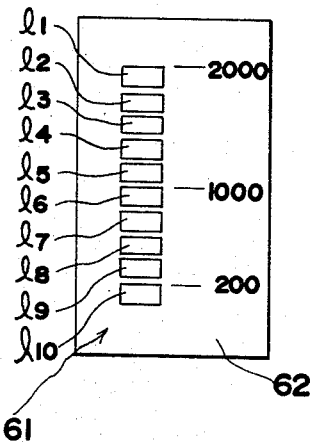
FIG. 17 shows an example of a display.

Further as shown in FIGS. 15 to 17, the number obtained by calculation may be indicated by a display which changes stepwise by a constant decrement (for example, of 200 sheets). More specifically, a display 61 comprising light-emitting diodes or liquid crystals and connected via a decoder 60 to output ports PHØ to PH3 of the MC 50 is arranged on an operation-display panel 62 along with copy sheet numbers as shown in FIG. 17. The operation shown in FIG. 16 is performed, and the MC 50 feeds the resulting output to the decoder 60 to turn on a corresponding number of display elements l1 to l10 for representing the result. When the number of remaining sheets is 1050, for example, the elements l5 to l10 are turned on, while if it is 250, the elements l9 and l10 are lighted up. When the result is up to 199 sheets, the element l10 only goes on. In this case, the number of remaining sheets may be shown specifically on the display 52 or a like numerical display. The display request switch SW8 is also usable.

While the accuracy of the remaining number obtained by calculation improves with an increase of the number of pulses relative to the amount of lift of the elevator, the period of pulses may be determined suitably considering the thickness of sheets usually used and the precision of operation of the upper and lower limit switches for the elevator so as to be justifiable in view of the precision needed.

Figure 14:
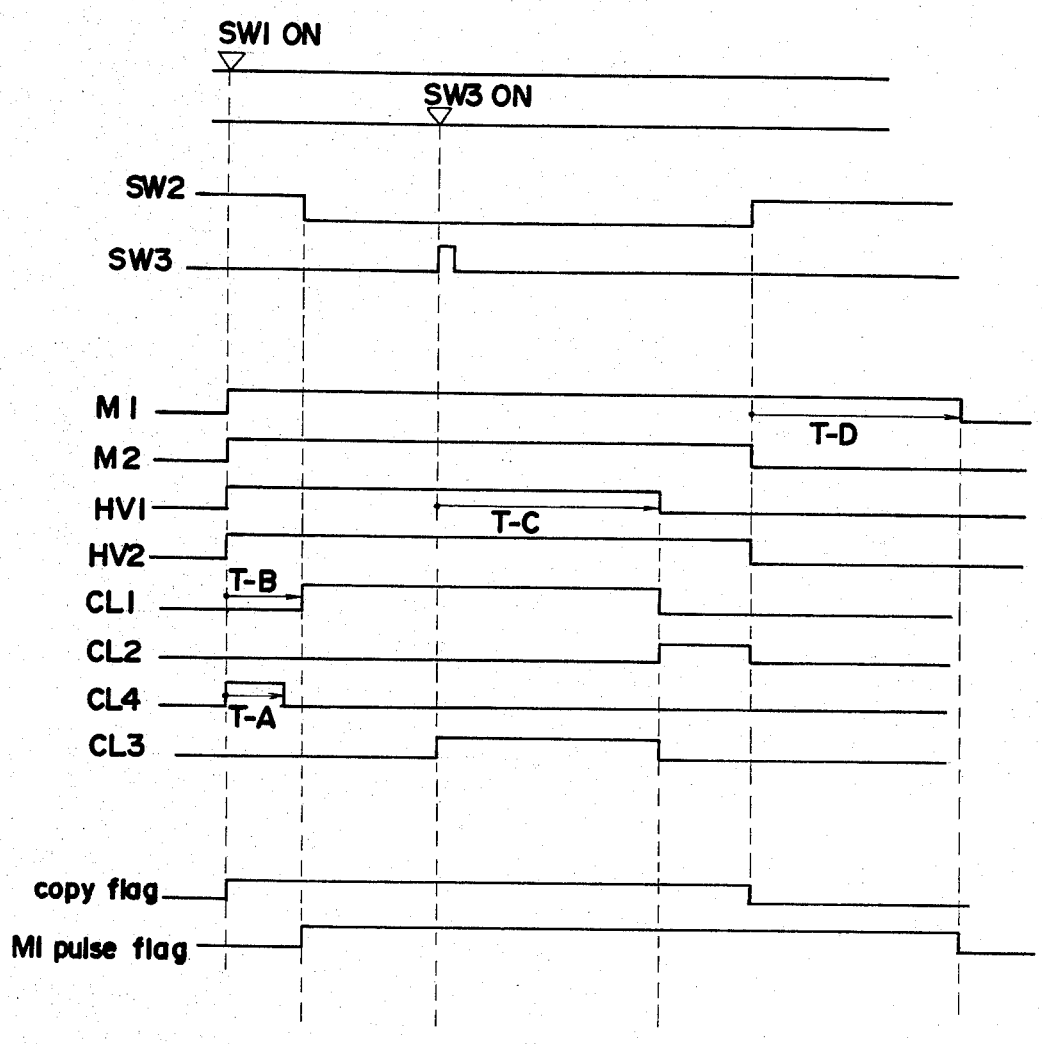
FIG. 14 is a time chart showing the operation of the copying machine.

FIG. 7(*b*) is a flow chart showing an exemplary mode of controlling the copying operation of the machine 1. The control mode will be described briefly also with reference to the time chart of FIG. 14.

When the print switch SW1 is turned on in the first block of FIG. 7(*b*), the main motor M1, the developing motor M2, the sensitizing charger 12, the transfer charger 14 and the feed roller clutch CL3 are operated, a copy flag is set to "1" to indicate that the machine is in operation, and control timers T-A and T-B are started.

Upon the lapse of the time set on the timer T-A in the second block, the clutch CL3 is turned off, and the copy number counter is advanced by an increment.

When the time set on the timer T-B is found to be up in the third block, the scan clutch CL1 is engaged to start a scan movement, while a motor pulse flag is set to "1". Consequently the subsequent control is effected with the use of pulse signals in synchronism with the rotation of the main motor M1.

In the fourth block, the timing roller switch SW3 is turned on during the scan movement of the optical system 20, whereupon the timing roller clutch CL3 is turned on and a timer T-C is set. A copy sheet is fed to the drum 10, as timed by the roller 35, with the travel of an image on the drum.

Upon the lapse of time set on the timer T-C in the fifth block, the sensitizing charger 12, the scan clutch CL1 and timing roller clutch CL3 are turned off, and the return clutch CL2 is turned on. The timer T-C may be set to a variable period of time in accordance with the size of the sheet to be used, etc.

In the sixth block, the optical system 20 returns to the home position and actuates the home position switch SW2, whereupon the developing motor M2, the transfer charger 14 and the return clutch CL2 are turned off, with the copy flag changed to "0". A timer T-D is set.

When the timer T-D finishes its operation in the seventh block, the main motor M1 is de-energized, and the motor pulse flag is changed to "0". The eighth block executes a process for giving various outputs.

The ninth block checks an internal timer as to the lapse of time set thereon, whereby the control processing time for the MC 50 is made constant regardless of the amount of processing.

The tenth block is a process wherein when the motor pulse flag is "1", the processing routine is repeated in response to a motor pulse input. Thus if the time set on the internal timer is t0 and the period of motor pulses is t, $t \gtrsim t0$.

The timers T-A to T-D, etc., described above with reference to the flow chart and the time chart are digital timers which are programmed to count up "1" for every processing routine to be performed by the MC 50 within the period of time determined by the internal timer. The time to be set on the digital timer is determined by presetting the count.

As already known, the copy number counter is a usual counter type which counts up "1" for every copying cycle, such that the resulting count can be judged by the MC 50.

The pulse signals from the pulse disk 42 which rotates with the motor M3 for the elevator 40 are fed to an input port PA3, via the transistor Tr2 as already stated. The MC 50 counts every input pulse signal with use of a suitable RAM, shift register or the like to perform the foregoing calculation. The pulse signal or copy number counting system and operation with use of the MC 50 are not illustrated specifically or described in detail herein for the above embodiment since such system and operation are disclosed in the aforementioned U.S. Pat. No. 4,280,763, which was incorporated herein to supplement this disclosure.

While the parameters of the present invention can be found in the above disclosure, this example should not be considered limiting, but rather illustrative of the advantages of the present invention, since persons skilled in this field, once knowing the general principles of the present invention, can make modifications therefrom.

Accordingly, the parameters of the present invention should be measured solely from the following claims, in which we claim:

1. In a paper feeder having a mechanism for holding a stack of sheets on a tray and lifting the stack to a predetermined upper limit position every time the height of the stack decreases by a specified amount due to removal of sheets from the tray, an apparatus for detecting the number of remaining sheets comprising:

means for generating corresponding signals relative to the lifting movement of the stack;

means for counting the number of sheets removed from the tray which corresponds to a predetermined lifting movement of the stack;

means for detecting the signals generated with a lifting movement of the stack to obtain numerical data corresponding to the amount of the lift;

means for obtaining numerical data corresponding to the height of the remaining stack; and means for calculating the number of remaining sheets from the data corresponding to the amount of the lift, the number of sheets used and the data corresponding to the height of the remaining stack and producing a representative signal.

2. Apparatus for detecting the number of remaining sheets as claimed in claim 1 wherein said signals generated with the lift are pulse signals generated in synchronism with the drive of the mechanism for lifting the stack.

3. Apparatus for detecting the number of remaining sheets as claimed in claim 1, further comprising means for displaying the result of the calculation from the representative signal.

4. Apparatus for detecting the number of remaining sheets as claimed in claim 1 further including a preset counter wherein said paper feeder is connected with said preset counter for setting the number of operating cycles of the paper feeder and further comprising means for generating a signal when the number set in the preset counter is larger than the number of remaining sheets available.

5. In an improved copying machine for making multiple copies of an original on copy paper sheets that are moved by a paper transport system and having means for setting a desired number of copies to be produced, means for supporting a stack of sheets of copy paper, means for removing a sheet of copy paper from the stack and introducing it into the paper transport system, means for adjusting the relative position of the stack and the means for removing to ensure a continual supply of copy paper sheets to the paper transport system and means for counting the number of copy paper sheets moved by the paper transport system, the improvement comprising:

means for providing an indication of the total initial height of the stack;

means for measuring an increment of relative movement of the stack;

means for correlating the number of copy paper sheets removed from the stack and counted by the means for counting with the increment of relative movement of the stack, and means for calculating the number of sheets of copy paper remaining on the stack from the relationship of the increment of movement, the height of the initial stack and the number of sheets counted and producing a corresponding signal of that number whereby a user can be informed of the relative storage condition of available copy paper sheets.

6. The invention of claim 5 further including means for displaying an indication of the status of the copy paper stack to the user.

7. The invention of claim 5 further including means for displaying the number of remaining sheets in the copy paper stack.

8. The invention of claim 5 further including means for comparing the number of remaining sheets in the copy paper stack and the number of copies desired to be produced and producing a warning signal when the number of copy paper sheets are less than the number of copies desired to be produced.

9. The invention of claim 5 wherein the means for calculating further includes means for automatically decrementing the signal representing the number of sheets of copy paper remaining on the stack by the actual number of copy paper sheets counted by the means for counting and displaying the resulting total number to the user.

10. The invention of claim 5 wherein the means for measuring an increment of relative movement includes a motor for driving the support means and a monitor for producing corresponding pulse signals.

11. The invention of claim 5 further including means for storing a signal representing a predetermined number of sheets of a small quantity, comparator means for comparing the predetermined signal with the calculated signal of actual sheets and an indicator which is activated when the calculated signal equals or is less than the predetermined signal to warn a user that the copy paper sheets are almost exhausted.

12. The invention of claim 8 wherein the warning signal is produced by a voice generating means.

13. The invention of claim 10 wherein the means for providing an indication of the total initial height of the stack includes upper and lower limit switches positioned at predetermined positions relative to the stack to deactivate the motor.

14. The invention of claim 13 further including means for initially moving the support means from one switch position to another switch position upon initialization of the copying machine and means for storing the pulse signals corresponding to the initial movement for use in determining the total initial height of the stack.

15. The invention of claim 14 further including a total pulse counter for counting the pulse signals upon initialization and a lift pulse counter for counting subsequent increment movement.

* * * * *